US006910664B2

(12) United States Patent
Bolinder et al.

(10) Patent No.: US 6,910,664 B2
(45) Date of Patent: Jun. 28, 2005

(54) REMOVABLE SIGN SUPPORT SYSTEM

(76) Inventors: Bruce Bolinder, 22 Millpond, Stansbury Park, UT (US) 84074; Joe Bolinder, 214 W. Utah Ave., Toole, UT (US) 84074

( * ) Notice: Subject to any disclaimer, the term of this patent is extended or adjusted under 35 U.S.C. 154(b) by 0 days.

(21) Appl. No.: 10/419,363

(22) Filed: Apr. 18, 2003

(65) Prior Publication Data

US 2004/0206860 A1 Oct. 21, 2004

(51) Int. Cl.[7] ..... G09F 15/00
(52) U.S. Cl. ..... 248/156; 40/607.09
(58) Field of Search ..... 248/545, 507, 248/508, 509, 530, 156; 40/607.08, 607.09, 607.04, 607.05, 607.06; 254/30, 31; 173/90, 91

(56) References Cited

U.S. PATENT DOCUMENTS

| | | | | | |
|---|---|---|---|---|---|
| 1,427,576 | A | | 8/1922 | Bryant | |
| 1,761,675 | A | | 6/1930 | Mick | |
| 4,161,310 | A | | 7/1979 | Parker | |
| 4,242,822 | A | * | 1/1981 | Black | 40/607.06 |
| 4,249,715 | A | * | 2/1981 | Repp | 248/545 |
| 4,326,352 | A | * | 4/1982 | Barth | 40/607.06 |
| 4,343,449 | A | * | 8/1982 | Osthus | 248/156 |
| 4,357,001 | A | * | 11/1982 | Schmanski et al. | 256/51 |
| 4,378,650 | A | * | 4/1983 | Ottoson | 40/607.08 |
| 4,422,621 | A | * | 12/1983 | Ekern | 254/30 |
| 4,483,506 | A | * | 11/1984 | Litwiller | 248/545 |
| 4,726,565 | A | | 2/1988 | Keller | |
| 4,738,433 | A | | 4/1988 | Hoff | |
| 4,910,901 | A | * | 3/1990 | Boyar | 40/607.06 |
| 4,910,902 | A | * | 3/1990 | Anderson | 40/607.06 |
| D312,196 | S | | 11/1990 | Norona | |
| 5,022,632 | A | | 6/1991 | Beideck | |
| 5,042,591 | A | * | 8/1991 | Hull | 173/91 |
| 5,123,623 | A | * | 6/1992 | McNamara | 248/545 |
| 5,161,781 | A | * | 11/1992 | Sohocki | 254/30 |
| 5,186,437 | A | | 2/1993 | Scott | |
| 5,224,687 | A | | 7/1993 | Geckler | |
| 5,305,976 | A | * | 4/1994 | Blanchard | 248/156 |
| 5,368,277 | A | * | 11/1994 | Moss | 254/30 |
| 5,464,192 | A | * | 11/1995 | Burnham | 254/30 |
| 5,499,795 | A | * | 3/1996 | Mathews | 254/30 |
| 5,502,910 | A | * | 4/1996 | Lucchesi | 40/607.06 |
| 5,529,287 | A | * | 6/1996 | Pelosi et al. | 254/129 |
| 5,597,151 | A | | 1/1997 | Duncan | |
| 5,681,030 | A | * | 10/1997 | Nall | 254/30 |
| 5,713,559 | A | * | 2/1998 | McClarin et al. | 254/124 |
| 5,794,918 | A | | 8/1998 | Price | |
| 5,833,215 | A | * | 11/1998 | Vandenburg | 254/30 |
| 5,865,490 | A | * | 2/1999 | Vowell | 294/57 |
| 5,903,991 | A | * | 5/1999 | Sasse | 40/607.04 |
| 5,904,115 | A | * | 5/1999 | Durbin et al. | 116/28 R |
| 2002/0139548 | A1 | * | 10/2002 | Connelly, Jr. | 173/90 |

* cited by examiner

*Primary Examiner*—Ramon O. Ramirez
*Assistant Examiner*—Ingrid Weinhold
(74) *Attorney, Agent, or Firm*—Thorpe North & Western, LLP

(57) ABSTRACT

A removable sign support system for supporting a sign on the ground includes a substantially upright support post, configured to removably receive a sign post. The support post has a substantially horizontal base affixed to its bottom end, with a plurality of spikes downwardly extending from the base into the ground, and a lifting connection fixedly attached to the support post. A removal device is provided for removing the support post from the ground, and includes a moveable column having a bottom end configured to bear upon the top of the ground near the base of the support post, and a lever arm pivotally attached to the moveable column. The removal device is configured to pull the spikes upwardly out of the ground by engaging the lever arm with the lifting connection and applying a substantially upward force thereon.

17 Claims, 2 Drawing Sheets

REMOVABLE SIGN SUPPORT SYSTEM

BACKGROUND OF THE INVENTION

1. Field of the Invention

The present invention relates generally to sign structures. More particularly, the present invention relates to a sign support system having a removable sign support structure and a freestanding lever arm sign removal device.

2. Related Art

Some types of signs, such as real estate for-sale signs, are frequently and repeatedly placed and removed. Naturally, their placement must provide sufficient strength to support the sign in its upright position, and to resist wind and other possible loads. However, it is desirable that these signs be reasonably easy to place and remove, and durable enough to be placed removed without substantial damage to the sign so that they can be reused many times. Sometimes temporary signs are placed or removed by persons who may be small or lack sufficient strength by themselves to properly install or remove the sign, and who may be working alone. For example, real estate agents frequently place and remove for-sale signs. Some of these signs must be strong enough to stand for many months or years. Additionally, these signs must sometimes be placed in hard or frozen ground.

Unfortunately, many removable signs that are now known are difficult to adequately install, and once installed properly, are difficult to remove, even by persons with substantial physical strength. Moreover, the configuration of some removable signs makes them highly susceptible to damage during installation and/or removal.

SUMMARY OF THE INVENTION

It has been recognized that it would be advantageous to develop a removable sign system that can be securely installed in the ground and quickly and easily removed by a single person with relatively limited strength.

The invention advantageously provides a removable sign support system for supporting a sign on the ground. The system includes a substantially upright support post, configured to removably receive a sign post. The support pose has a substantially horizontal base affixed to its bottom end, and a plurality of spikes downwardly extending from the base into the ground. A lifting connection is fixedly attached to the support post. A removal device is provided for removing the support post from the ground. The removal device includes a moveable column having a bottom end configured to bear upon the top of the ground near the base of the support post. A lever arm is pivotally attached to the moveable column, and is configured to pull the spikes upwardly out of the ground by engaging and applying a substantially upward force upon the lifting connection.

Additional features and advantages of the invention will be apparent from the detailed description which follows, taken in conjunction with the accompanying drawings, which together illustrate, by way of example, features of the invention.

DETAILED DESCRIPTION

Figure 1:
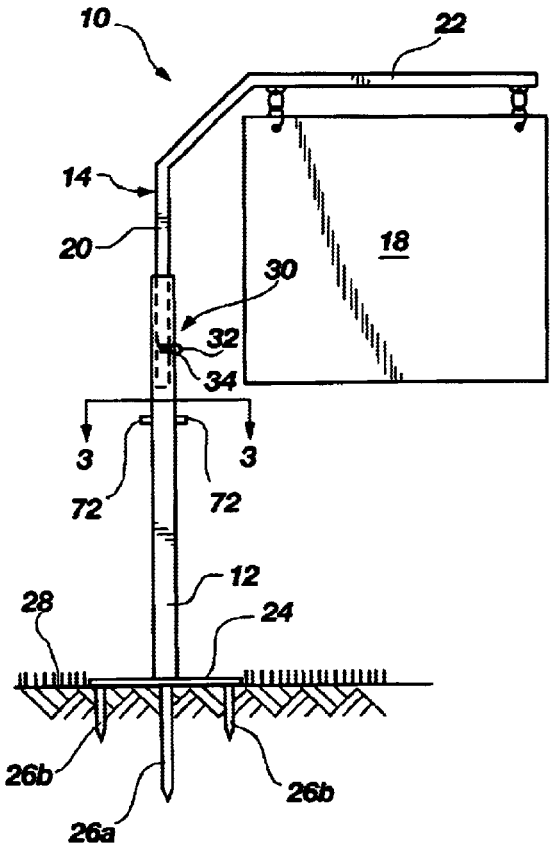
FIG. 1 is a front view of one embodiment of a sign support system in accordance with the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

Figure 2:
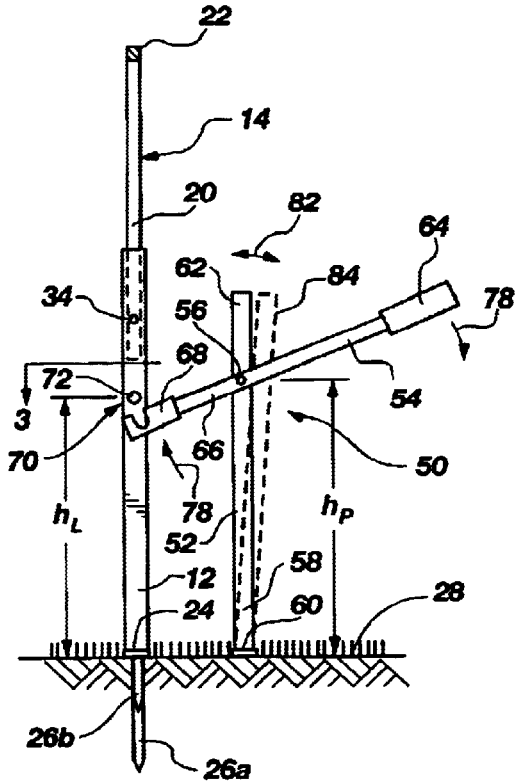
FIG. 2 is a side view of the sign support system of FIG. 1.

As illustrated in FIGS. 1 and 2, the present invention provides a removable sign support system, indicated generally at 10, comprising an upright support post 12, and a removable sign post 14. The upright support post is a metal tube, such as a square steel tube as shown, with a central aperture 16 that is open at its top for receiving the lower end of the sign post. It will be apparent that other post shapes may be used, such as round tubes, hexagonal tubes, etc. The sign post is of the same shape as the support post, and is configured to telescopically slide into the top of the support post. The sign post is configured to directly support a sign 18, such as a "For Sale" sign. In the configuration shown, the sign post has an inverted "L" shape, having a vertical portion 20 that fits into the support post, and a horizontal arm 22 from which the sign hangs. It will be apparent that the sign could take many other configurations as well.

Fixedly attached to the bottom of the support post is a transverse base plate 24, such as a flat steel bar, with several downwardly directed ground spikes, indicated generally at 26, for penetrating into the ground 28. In the embodiment shown, the ground spikes include a longer center spike 26*a* directly below the support tube, and two shorter stabilizer spikes 26*b* located at opposing extremities of the base support. Other spike configurations may also be used. These spikes secure the upright support post 12 in the ground, and, in combination with the wide stance of the base plate, help resist overturning moments due to wind, impact, and other forces.

Near the top of the upright support post 12 is a detent 30 for positioning and holding the sign post 14 within the support post. The detent includes a spring-loaded detent pin 32 attached to the lower end of the vertical portion 20 of the sign post, and a corresponding detent hole 34 extending through a side of the upright support post. To insert the sign post into the support post, a user depresses the detent pin into the lower end of the sign post, then inserts the lower end of the sign post into the top of the support post so that the detent pin and detent hole can come into alignment. Advantageously, the exposed end of the detent pin is rounded, such that it slides easily within the larger support tube, notwithstanding that it presses against the inside of the support tube as it slides. When the detent pin reaches a position where it is aligned with the detent hole, the pin snaps through the hole and locks the two tubes into position with respect to each other. To remove the sign post from the support post, the user simply presses the detent pin into the detent hole while pulling on the sign post, so that the sign post can be slidingly removed from the support post in the opposite manner of its insertion.

It will be apparent that some types of signs, such as real estate for-sale signs, are frequently and repeatedly placed and removed. Naturally, their placement must provide sufficient strength to support the sign and to resist wind and other possible loads, yet be reasonably easy to remove. At the same time, these signs frequently must be placed or removed by persons who may be small or lack sufficient strength by themselves to properly install or remove the sign, and who may be working alone. Advantageously, the removable sign system of the present invention is configured to be securely installed and quickly removed by a single person of relatively limited strength.

Insertion of the support post 12 into the ground can be accomplished in several ways. The particular method chosen may depend upon the hardness of the ground or the strength of the user. Because the base plate 24 is a relatively rigid metal bar, a user may simply step or stand upon the base plate while holding the support post substantially upright, so as to drive the spikes 26 into the ground using their body weight. The effectiveness of this method may depend on the weight of the user and the type of shoes they are wearing. It will be apparent that this method may be ineffective for a petite woman in high-heeled shoes, for example. Alternatively, a user could use a hammer or other similarly useful tool to pound upon the base plate and drive the spikes into the ground. It will be apparent, however, that driving the spikes by this latter method may tend to tilt the support post, given that the exposed portions of the base plate are not aligned with the vertical axis of the support post.

Figure 5:
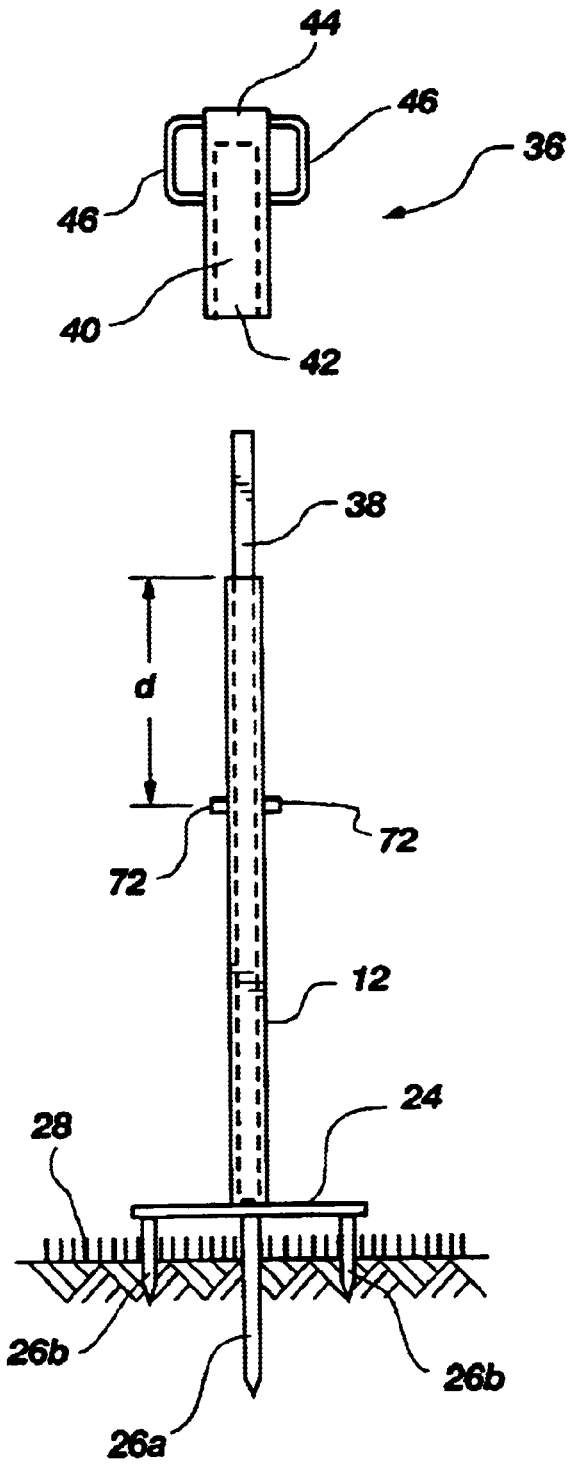
FIG. 5 is a front view of the support post configured to be driven into the ground.

Referring to FIG. 5, the support post 12 may alternatively be set in the ground using a post hammer 36 and hard steel driving rod 38. The post hammer comprises a strong metal tube 40 with an open bottom end 42 and a closed top end 44. Disposed along the two sides of the tube are handles 46. To drive the support post into the ground, the driving rod is inserted into the central aperture 16 of the support post. The driving rod is long enough to contact the top of the base plate 24 inside the bottom end of the support post, and also extend above the top of the support post. The driving rod provides a strong structure against which the post hammer can strike without damaging the top of the support post. When the post hammer strikes the top of the driving rod, the thick, heavy closed top end of the post hammer strikes the top of the driving rod, which bears against the base plate, and drives the spikes into the ground.

In one embodiment, the ends of the driving rod 38 are tapered to a smaller cross-section than in the middle. This feature provides several advantages. First, it allows the driving rod to fit into the support post 12 even if the end happens to become slightly mushroomed due to pounding. Second, the taper at the bottom end allows the driving rod to more likely bear upon the base plate 24 itself, rather than possibly on weld material connecting the support post to the base plate. Additionally, the tapered end of the driving rod makes it easier to insert into the support post.

Figure 3:
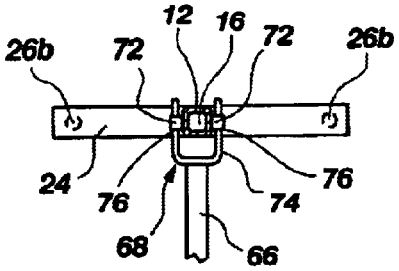
FIG. 3 is a top cross-sectional view of the sign support system of FIG. 1, showing the engagement end of the lever arm engaged with the lifting pins.
Figure 4:
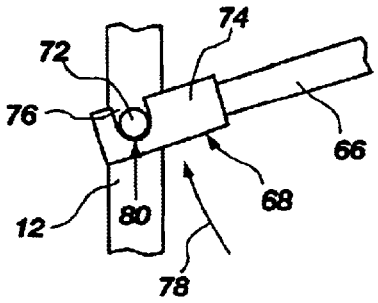
FIG. 4 is a side detail view of the engagement end of the lever arm.

Regardless of the method chosen to install the support post 12, when it is time to remove the sign from the ground, this can be difficult, even for persons of substantial physical strength. Referring to FIGS. 2–4, the removable sign support system 10 of the present invention includes a sign removal device 50. The removal device includes a portable or moveable column 52, with a lever arm 54 pivotally attached thereto at a pivot point 56. The bottom end 58 of the column includes a ground plate 60 configured to support the column on the surface of the ground 28. The size of the ground plate can be selected to provide sufficient load-bearing area so that the column of the removal device will not sink into the ground excessively when expected loads are placed upon the removal device. The top end 62 of the column extends a distance above the pivot point, and provides a convenient location for a user to grip the column to hold it and steady it.

The lever arm 54 includes a handle end 64 on one side of the pivotal attachment, and an engagement end 66 on the opposite side of the pivotal attachment. In order to provide leverage or mechanical advantage, the distance from the pivot point 56 to the end of the handle is preferably longer than distance from the pivot point to the engagement end. In one embodiment, the length of the handle end is approximately twice the length of the engagement end.

The engagement end includes a forked hook 68 that is configured to engage a removal connector 70 disposed on the support post 12. In the embodiment shown, the removal connector comprises a pair of lift posts 72 extending from opposing sides of the support post. The lift posts are fixedly attached to the support post, and provide secure lifting points for being engaged by the forked hook 68. Referring to FIGS. 3 and 4, the forked hook comprises a U-shaped member 74 that is fixedly attached to the lever arm, with a pair of rounded-bottom lift slots 76 disposed in opposing sides of the fork. The fork is configured to fit around the outside of the support post, so that the lift slots may be engaged with the lift pins from below. The lift slots may also be tapered, as shown, to facilitate easy sliding insertion of the lift pins into the slots.

Referring back to FIG. 2, to remove the support post 12 from the ground, the user places the ground plate 60 of the removal device 50 on the ground near but spaced away from the base plate 24 of the support post. The lateral distance between the base plate of the support post and the bearing position of the ground plate of the removal device should be chosen to allow the lift slots 76 of the forked hook to engage the lift posts 72 from below when the lever arm 54 is rotated in the directions of arrows 78, while still keeping the column 52 substantially vertical. When the lift slots engage the lift posts, the mechanical advantage of the lever arm allows the user to apply an upward force on the support post that is much greater than the downward force the user applies to the handle of the lever arm.

Advantageously, the lift posts 72 are symmetrically disposed on opposite sides of the support post, such that simultaneous upward force on these posts imposes a substantially upward force on the support post, without bending, twisting, or pushing the post laterally. The imposition of a substantially upward force can be further facilitated by the user laterally moving the top of the column 52 very slightly so that the rounded bottom end 80 of the lift slots 76 engages the lift posts at a point that is as close as possible to the true bottom point of the lift posts.

There are a couple of considerations related to the vertical position of the lifting posts 72 along the support post. On the one hand, as shown in FIG. 5, the lifting posts are placed a distance d below the top of the support post so that the post hammer will not strike and damage them when it is brought down upon the top end of the driving rod. At the same time, referring to FIG. 2, the vertical height $h_L$ of the lifting posts 72 relative to the surface of the ground 28 (i.e. relative to the bottom of the base plate 24) is preferably less than the height $h_p$ of the pivot point above the ground plate 60 of the removal device 50. This causes the engagement end of the lever arm to engage the lifting posts when the handle of the lever arm is in a relatively high position, providing ample room for the handle to swing downward as the lever arm is rotated to draw the support post out of the ground. In one embodiment, the height of the pivot point relative to the lifting posts is selected so that about half of the total vertical travel of the support post that is needed to remove the spikes from the ground is completed by the time the lever arm reaches a horizontal position.

However, it will also be apparent the available leverage will be greatest when the lever arm is close to horizontal, and the greatest leverage is likely to be needed at the beginning of the lifting operation. Consequently, the height of the pivot point relative to the height of the support posts can be selected so as to balance the need for room to rotate the lever arm for full motion, and the need for greatest leverage at the beginning of the removal operation.

It will also be apparent that because the lever arm 54 pivots, the forked hook will tend to move along an arcuate path as the user pushes down on the handle end 64. This can tend to push the support post laterally as it is lifted. Slight lateral deflection of the support post can be desirable during removal, depending on the characteristics of the soil into which it has been driven. However, the present invention allows the user to eliminate lateral motion of the engagement end of the lever arm if desired by slight movement of the top of the column back and forth, as indicated by arrow 82, during the lifting motion. As the lever arm moves from its initial position with the handle raised (as shown in FIG. 2) toward the horizontal, the forked hook will tend to push the support post away from the user. During this motion, the user can counter this tendency by pulling the top of the column slightly away from the support post toward a tilted position 84, indicated by dashed lines in FIG. 2.

Conversely, as the user continues to rotate the handle 64 of the lever arm 54 down so that the forked hook 68 rotates upwardly, this will tend to pull the support post 12 toward the user as it continues to lift it out of the ground 28. During this part of the motion, the user can rotate the top of the column 52 from the tilted position 84 back toward the support post, again countering lateral movement of the engagement end. The result of this process is that a user can cause the lift slots 76 to move through a substantially vertical motion, with little or no lateral translation, rather than move through an arcuate path. This allows the user to apply substantially only a vertical lifting force upon the support post when removing it, without imposing other forces.

Another advantageous feature of the invention is the placement of the lifting posts 72 upon the support post 12. As shown in FIGS. 1 and 3, the lifting posts are disposed on opposing sides of the support post so as to be substantially parallel with the base plate 24. This arrangement causes a user to remove the support post from a side of the support post away from the base plate. In other words, if the lifting posts were perpendicular to the base plate, the proper place to position the ground plate 60 of the removal device 50 would be along the line of the base plate. Depending upon the length of the base plate, this could cause a user to unintentionally place the ground plate of the removal device upon the base plate itself, rather than on the ground. This is especially possible if the base plate is obscured by dirt, snow, or other debris. Naturally, the support post cannot be removed from the ground if the column is placed against the base plate, rather than the ground. In such a situation, force upon the lever arm would simply tend to bend the base plate relative to the support post tube. Advantageously, with the lifting posts disposed parallel to the base plate, the user will necessarily place the removal device on a side of the support post away from the base plate in order to engage the lifting posts.

It is to be understood that the above-referenced arrangements are illustrative of the application for the principles of the present invention. Numerous modifications and alternative arrangements can be devised without departing from the spirit and scope of the present invention while the present invention has been shown in the drawings and described above in connection with the exemplary embodiments(s) of the invention. It will be apparent to those of ordinary skill in the art that numerous modifications can be made without departing from the principles and concepts of the invention as set forth in the claims.

What is claimed is:

1. A removable sign support system for supporting a sign on ground, comprising:

a) a substantially upright support post, configured to removably receive a sign post, having a substantially horizontal base affixed to a bottom thereof, a plurality of spikes downwardly extending from the base into the ground, and a lifting connection fixedly attached to the support post;

b) a removal device, including a moveable column having a bottom end configured to bear upon a top surface of the ground near the base of the support post, and a lever arm pivotally attached to the moveable column at a pivot point, the lever arm being configured to pull the spikes upwardly out of the ground when rotated, by engaging and applying a substantially upward force upon the lifting connection;

c) a driving rod, having a top end and a bottom end, configured to be inserted into the support post with the sign post removed therefrom, such that the bottom end contacts the horizontal base, and the top end extends above a top end of the support post; and d) a hammer, configured to strike the top end of the driving rod, so as to drive the base and spikes into the ground.

2. A removable sign support system according to claim 1, wherein the lifting connection comprises a pair of lift pins disposed on opposing sides of the support post, and wherein the lever arm further comprises a forked hook, configured to engage the pair of lifting pins.

3. A removable sign support system according to claim 1, further comprising a sign post, having a substantially vertical portion configured to be removably inserted into a top portion of the support post, and a sign, attached to the sign post.

4. A removable sign support system according to claim 3, further comprising a detent, including a spring-biased pin, associated with the substantially vertical portion of the sign post, and a detent hole, associated with the top portion of the support post, the pin configured to engage the detent hole when the sign post is inserted into the support post, so as to secure the sign post with respect to the support post.

5. A removable sign support system according to claim 1, wherein the support post comprises a tubular steel post.

6. A removable sign support system according to claim 5, wherein the tubular steel support post is substantially square in cross-section.

7. A removable sign support system according to claim 1, wherein the lever arm comprises an engagement end on one side of the pivot point, configured to engage the lifting connection, and a handle end disposed on an opposite side of the pivot point, the handle end having a length that is approximately twice a length of the engagement end.

8. A removable sign support system according to claim 1, wherein the lifting connection is disposed a first distance above the ground, and the pivot point is disposed a second distance above the ground, the second distance being greater than the first distance.

9. A removable sign system, comprising:

a) a sign support, including i) a substantially upright support post, having a bottom end and a top end, the top end configured to removably receive a sign post therein;

ii) a base, affixed to the bottom end of the support post and extending laterally therefrom, having a plurality of spikes downwardly extending therefrom, for securing the support post in ground; and iii) a removal connector, fixedly disposed on the tubular support post;

b) a sign removal device, including i) a moveable column, having a bottom end configured to bear upon a surface of the ground; and ii) a lever arm, pivotally attached to the moveable column, having a handle end and an engagement end, the engagement end configured to engage and apply a substantially upward force upon the removal connector so as to remove the spikes of the sign support from the ground;

c) a driving rod, having a top end and a bottom end, configured to be inserted into the support post with the sign post removed therefrom, such that the bottom end contacts the horizontal base, and the top end extends above a top end of the support post; and d) a hammer, configured to strike the top end of the driving rod, so as to drive the base and spikes into the ground.

10. A removable sign system according to claim 9, wherein the removal connector comprises a pair of lift pins, disposed on opposing sides of the support post, and wherein the lever arm further comprises a forked hook, configured to engage the pair of lifting pins.

11. A removable sign system according to claim 9, further comprising:

a) a sign post, having a substantially vertical portion, configured to be removably inserted into a top portion of the support post; and b) a sign, attached to the sign post.

12. A removable sign system according to claim 9, wherein the plurality of spikes comprises three spikes, including a longer spike substantially aligned with the support post, and two shorter spikes disposed at opposite extremities of the base.

13. A removable sign system, comprising:

a) a sign support, including i) a substantially upright tubular support post, having a bottom end and an open top end;

ii) a base support, affixed to the bottom end of the support post and extending laterally therefrom, having a plurality of spikes downwardly extending therefrom, for securing the support post in ground; and iii) a removal connector, fixedly disposed on the tubular support post;

b) a sign support member, having a substantially vertical portion configured to be slidingly received into the top end of the tubular support post; and c) a sign, attached to the sign support member;

d) a sign removal device, including i) a moveable column, having a bottom end configured to engage a surface of the ground; and ii) a lever arm, pivotally attached to the moveable column, having a handle end on one side of the pivotal attachment, and an engagement end on an opposite side of the pivotal attachment, the engagement end configured to engage the removal connector, such that the sign support may be removed from the ground by placing the bottom of the moveable column on the ground near the base support, and rotating the lever arm to engage the removal connector and apply a substantially upward force on the removal connector and the support post;

e) a driving rod, having a top end and a bottom end, configured to be inserted into the support post with the sign support member removed therefrom, such that the bottom end contacts the base support, and the top end extends above the top end of the support post; and f) a hammer, configured to strike the top end of the driving rod, so as to drive the base and spikes into the ground.

14. A method for placing and removing a temporary sign support post in ground, comprising the steps of:

a) driving a base with a plurality of spikes and an attached substantially vertical support post into the ground, by (i) inserting a driving rod into the support post so as to contact a bottom end of the driving rod with the base, and (ii) pounding a top end of the driving rod with a hammer, so as to drive the base and spikes into the ground;

b) engaging a lever arm upon a diametrical lifting point on the vertical support post while placing a fulcrum associated with the lever arm upon the ground near the base; and c) pulling the spikes from the ground by rotating the lever arm and applying a substantially vertical force upon the diametrical lifting point.

15. A method in accordance with claim 14, further comprising the steps of:

d) attaching a sign to a top end of the support post; and e) removing the sign from the top end of the support post before engaging the lever arm and pulling the spikes from the ground.

16. A method in accordance with claim 14, further comprising the step of:

d) tilting a vertical column pivotally connected to the lever arm, while rotating the lever arm, so as to cause an engagement end of the lever arm to move substantially vertically while the lever arm is rotated.

17. A method in accordance with claim 14, wherein the step of engaging the lever arm upon a diametrical lifting point on the vertical support post further comprises engaging a pair of lift pins disposed on opposing sides of the support post with a forked hook disposed on the lever arm.

* * * * *